US010815109B2

(12) United States Patent
Piramoon

(10) Patent No.: US 10,815,109 B2
(45) Date of Patent: Oct. 27, 2020

(54) CLOSURE TOOL FOR A CENTRIFUGE SAMPLE CONTAINER AND METHOD FOR REMOVING A CLOSURE FROM A CENTRIFUGE SAMPLE CONTAINER

(71) Applicant: Fiberlite Centrifuge, LLC, Santa Clara, CA (US)

(72) Inventor: Sina Piramoon, San Jose, CA (US)

(73) Assignee: Fiberlite Centrifuge LLC, Santa Clara, CA (US)

( * ) Notice: Subject to any disclaimer, the term of this patent is extended or adjusted under 35 U.S.C. 154(b) by 0 days.

(21) Appl. No.: 15/605,337

(22) Filed: May 25, 2017

(65) Prior Publication Data

US 2018/0339892 A1 Nov. 29, 2018

(51) Int. Cl.
*B67B 7/18* (2006.01)
*B01L 3/00* (2006.01)
(Continued)

(52) U.S. Cl.
CPC ..... *B67B 7/18* (2013.01); *B01L 99/00* (2013.01); *B67B 7/14* (2013.01); *B67B 7/44* (2013.01);
(Continued)

(58) Field of Classification Search
CPC .... B67B 7/18; B67B 7/16; B67B 7/44; B01L 3/5021; B01L 3/50825; B01L 2200/0689;
(Continued)

(56) References Cited

U.S. PATENT DOCUMENTS 514,200 A * 2/1894 Painter ..... B67B 7/16 215/226
757,548 A * 4/1904 Goodrich ..... B65D 51/243 215/226
(Continued)

FOREIGN PATENT DOCUMENTS

CH 641423 A5 * 2/1984
DE 202011101627 * 11/2012

OTHER PUBLICATIONS

Fiberlite Bottles Training (Year: 2017).*
(Continued)

*Primary Examiner* — Orlando E Aviles
*Assistant Examiner* — Mahdi N Nejad
(74) *Attorney, Agent, or Firm* — Wood Herron & Evans LLP

(57) ABSTRACT

A tool for removing first and second centrifuge bottle closure members from a centrifuge bottle includes a tool head including an aperture sized and shaped to receive a protruding portion of the first centrifuge bottle closure member. The tool further includes an elongate shaft extending from the tool head to a distal end and including a tapered portion adjacent the distal end. The tapered portion is sized and shaped to be at least partially inserted in a recessed portion of the second centrifuge bottle closure member. The aperture is configured to transfer torque to the first centrifuge bottle closure member during a rotating operation of the tool and the tapered portion is configured to exert an output force on the second centrifuge bottle closure member during a prying operation of the tool.

12 Claims, 5 Drawing Sheets

(51) Int. Cl.
*B67B 7/14* (2006.01)
*B01L 99/00* (2010.01)
*B67B 7/44* (2006.01)

(52) U.S. Cl.
CPC ..... *B01L 3/5021* (2013.01); *B01L 3/50825* (2013.01)

(58) Field of Classification Search
CPC ..... B01L 2300/042; B25B 27/0085; B25B 27/308; B25B 5/101; B25B 27/0042; F16F 1/24; F16N 3/12; A61B 5/150351
USPC ..... D9/443; 81/3.08, 3.4
See application file for complete search history.

(56) References Cited

U.S. PATENT DOCUMENTS 1,960,531 A * 5/1934 Driscoll ..... B67B 3/2006 279/102
2,542,329 A 2/1951 Hammond, Jr.
3,121,355 A * 2/1964 Morel ..... B25B 27/0042 81/176.2
3,938,735 A * 2/1976 Wright ..... B04B 5/0414 220/315
4,537,320 A * 8/1985 Nielsen ..... B04B 5/0414 215/276
4,683,782 A * 8/1987 Warburg ..... B67B 7/16 81/3.57
4,723,465 A * 2/1988 Hughes ..... B67B 7/44 81/3.09
D316,362 S * 4/1991 Hughes ..... D8/40
5,253,551 A * 10/1993 DeVaughn ..... B01L 3/5021 422/918
D359,212 S 6/1995 Skiba
D391,134 S 2/1998 Laib
D392,527 S 3/1998 Cortes et al.
5,752,604 A * 5/1998 Hayman ..... B65D 21/022 206/508
5,950,504 A * 9/1999 Italia ..... B01L 3/021 7/151
6,105,468 A * 8/2000 Fohrman ..... B67B 7/44 81/3.09
6,309,603 B1 * 10/2001 Locke ..... B67B 7/02 210/360.1
D499,618 S 12/2004 Lin et al.
D505,847 S 6/2005 Kelleghan
7,004,049 B2 * 2/2006 So ..... B67B 7/32 30/418
7,387,049 B1 * 6/2008 Ver Hage ..... A01K 7/00 53/490
D593,247 S 5/2009 Maxik et al.
D642,881 S 8/2011 Christopher
8,105,556 B2 * 1/2012 Romanauskas ..... B01L 9/06 220/315
8,215,508 B2 * 7/2012 Baird ..... B01L 3/5021 215/276
D692,286 S 10/2013 Hager
9,038,503 B2 * 5/2015 Bartholomew ..... B01L 3/50853 81/3.09
9,079,757 B2 * 7/2015 Bjork ..... B01L 99/00
D755,595 S 5/2016 Dauster
D777,941 S * 1/2017 Piramoon ..... B67B 7/16 D24/224
D796,280 S 9/2017 Godoy et al.
D850,874 S * 6/2019 Piramoon ..... D8/40
2016/0158745 A1 * 6/2016 Piramoon ..... B01L 3/5021 422/548
2018/0339892 A1 11/2018 Piramoon

OTHER PUBLICATIONS

Fiberlite Bottle System Datasheet EN_Draft_11-01-2019_Final (Year: 2018).*
50155989_a_thermo_scientific_fiberlite_bottles_en (Year: 2017).*
Thermo Scientific Fiberlite Bottle tool (Year: 2020).*

* cited by examiner

CLOSURE TOOL FOR A CENTRIFUGE SAMPLE CONTAINER AND METHOD FOR REMOVING A CLOSURE FROM A CENTRIFUGE SAMPLE CONTAINER

CROSS-REFERENCE TO RELATED APPLICATION

The present application is related to U.S. Design application Ser. No. 29/604,232, filed May 16, 2017, and titled "Closure Tool."

FIELD OF THE INVENTION

The present invention relates generally to tools and, more particularly, to tools and methods for removing closures from sample containers for use in a centrifuge.

BACKGROUND OF THE INVENTION

Laboratory applications frequently require centrifugation to separate samples into various components having different densities. Each sample is placed inside of a sample container through a mouth of the container body, which is then securely sealed with a closure to ensure that the sample remains within the container during centrifugation. Known closures include first and second closure members such as a lid and a sealing plug, the lid being configured to threadedly engage the sample container body, such that the closure may be rotated relative to the container body for attachment and removal. The assembled sample container is lowered into a cavity of a centrifuge rotor, which is then rotated by a centrifuge to achieve separation of the sample into its components.

Some closures prove difficult to be adequately gripped by users, particularly those having small hands, when rotating the closure for attachment and removal. Thus, some closures (e.g., large-diameter closures for use with 1 liter sample containers) are equipped with a handle such as that described in Applicant's own co-pending application Ser. No. 14/936,196, the disclosure of which is hereby incorporated herein by reference in its entirety.

Nevertheless, some users continue to experience difficulty in applying sufficient torque to such handles for attachment and/or removal of the closure from a container. Moreover, the sealing plug of some closures may remain suctioned and/or held by friction to the mouth of the container body such that the sealing plug becomes separated from the lid when the lid is removed from the container. In such cases, the user must then muster sufficient strength to overcome the suction and/or friction force in order to remove the sealing plug from the mouth and access the contents of the container.

Thus, it would be desirable to provide a tool and a method for improved removal of closures from sample containers.

SUMMARY OF THE INVENTION

The present invention provides improvements to overcome shortcomings of known closures for centrifuge sample containers. While the invention will be described in connection with several embodiments, it will be understood that the invention is not limited to these embodiments. On the contrary, the invention includes all alternatives, modifications, and equivalents as may be included within the spirit and scope of the present invention.

In one embodiment, a tool for removing first and second centrifuge bottle closure members from a centrifuge bottle includes a tool head including an aperture sized and shaped to receive a protruding portion of the first centrifuge bottle closure member. The tool further includes an elongate shaft extending from the tool head to a distal end and including a tapered portion adjacent the distal end. The tapered portion is sized and shaped to be at least partially inserted in a recessed portion of the second centrifuge bottle closure member. The aperture is configured to transfer torque to the first centrifuge bottle closure member during a rotating operation of the tool and the tapered portion is configured to exert an output force on the second centrifuge bottle closure member during a prying operation of the tool.

In another embodiment, a method of removing first and second centrifuge bottle closure members coupled to a centrifuge bottle, the first centrifuge bottle closure member including a protruding portion and the second centrifuge bottle closure member including a recessed portion, is provided. The method includes fitting a tool head of a tool over the protruding portion of the first centrifuge bottle closure member, applying a first force to an elongate shaft of the tool, generating a first torque at the tool head from the first force, and transferring the first torque to the protruding portion to loosen the coupling of the first centrifuge bottle closure member to the centrifuge bottle. The method further includes removing the first centrifuge bottle closure member from the centrifuge bottle and at least partially inserting a tapered portion of the elongate shaft in the recessed portion. The method also includes applying a second force to the tool head, generating a second torque at the tapered portion from the second force, and generating an output force from the second torque, the output force being exerted by the tapered portion on the recessed portion to loosen the coupling of the second centrifuge bottle closure member to the centrifuge bottle. The method further includes removing the second centrifuge bottle closure member from the centrifuge bottle.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
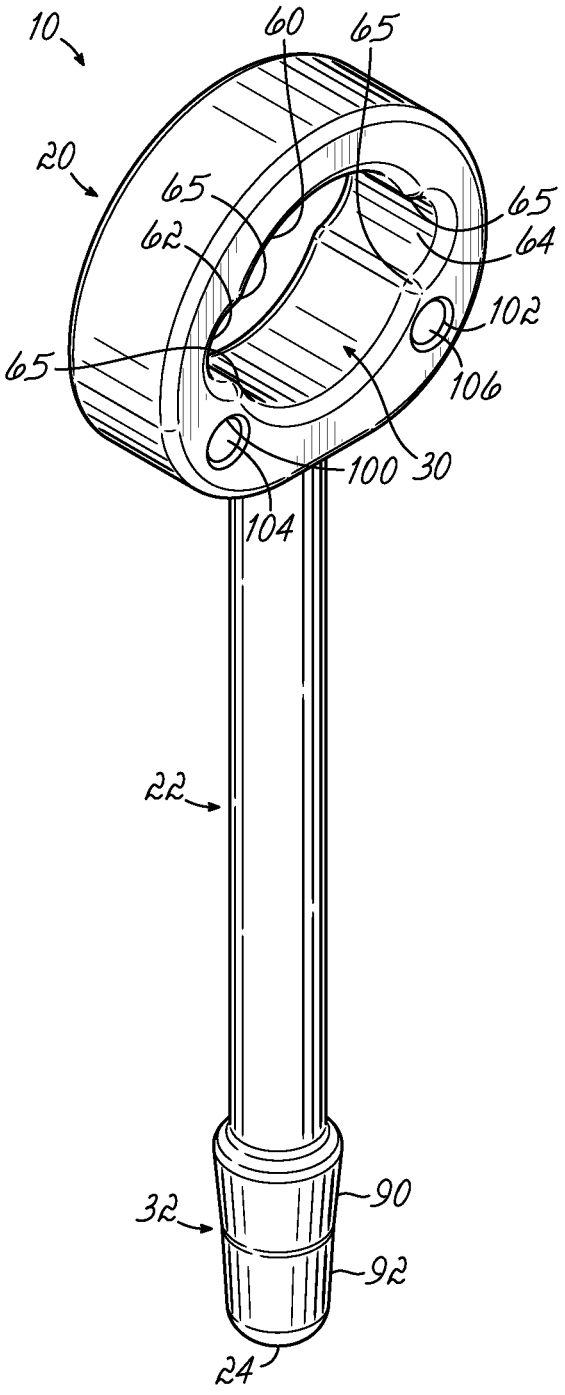
FIG. 1 is a perspective view of a tool for removing a closure from a centrifuge bottle in accordance with one embodiment of the invention.
Figure 2:
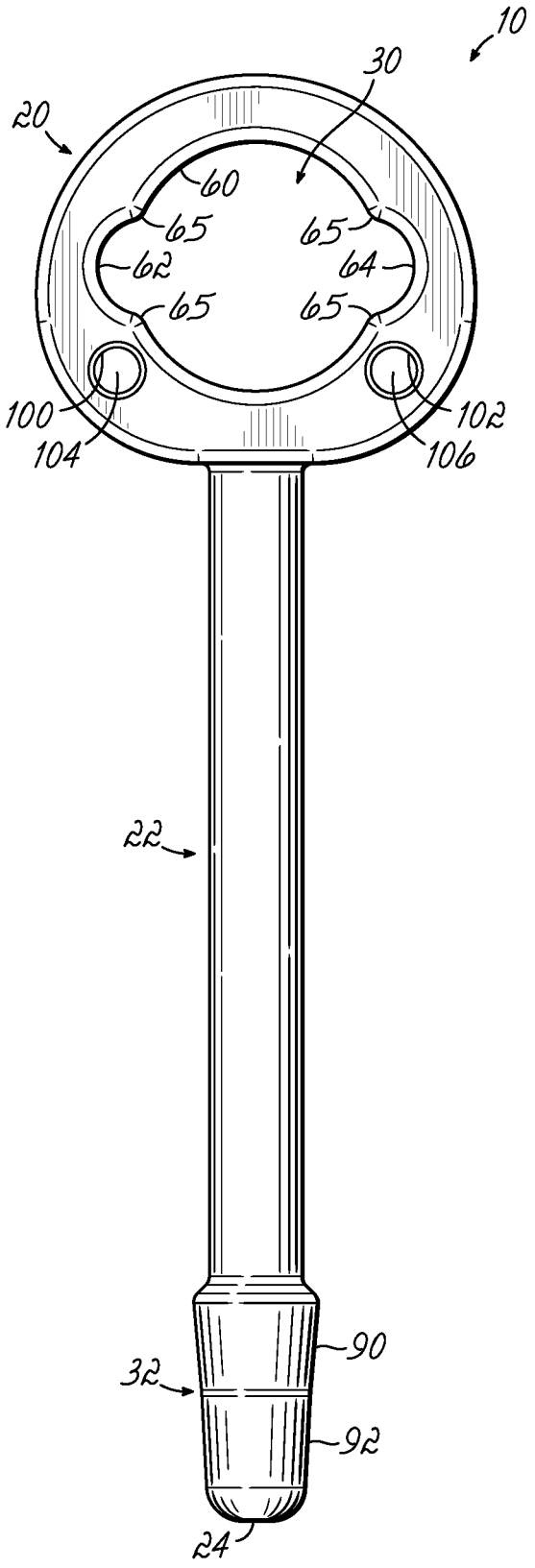
FIG. 2 is a front elevation view of the tool of FIG. 1.

Turning now to the figures, and with reference to FIGS. 1 and 2 in particular, an exemplary tool 10 for removing a closure 12 from a sample container, such as a centrifuge bottle 14 (FIG. 3A), includes a tool head 20 and an elongate shaft 22 extending from the tool head 20 to a distal end 24.

The tool head 20 includes a socket or aperture 30 and the elongate shaft 22 includes a tapered portion 32 adjacent the distal end 24. The tool 10 may be a multi-purpose tool for removal of multiple members of the closure 12 from the centrifuge bottle 14. For example, a user may perform a rotating operation with the tool 10, wherein the aperture 30 transfers a first torque (e.g., from the elongate shaft 22) to a first closure member, such as a lid 40 (FIG. 3A), in order to loosen the lid 40 from the centrifuge bottle 14. Once the lid 40 has been removed from the centrifuge bottle 14, the user may subsequently perform a prying operation with the tool 10. In particular, the tapered portion 32 may exert an output force generated by a second torque (e.g., from the tool head 20 and/or elongate shaft 22) on a second closure member, such as a sealing plug 42 (FIG. 3B), in order to loosen the sealing plug 42 from the centrifuge bottle 14. Thus, the tool 10 may improve a user's ability to fully remove the closure 12 from the centrifuge bottle 14. The features of the tool 10 are set forth in further detail below to clarify each of these functional advantages and other benefits provided in this disclosure.

Figure 3A:
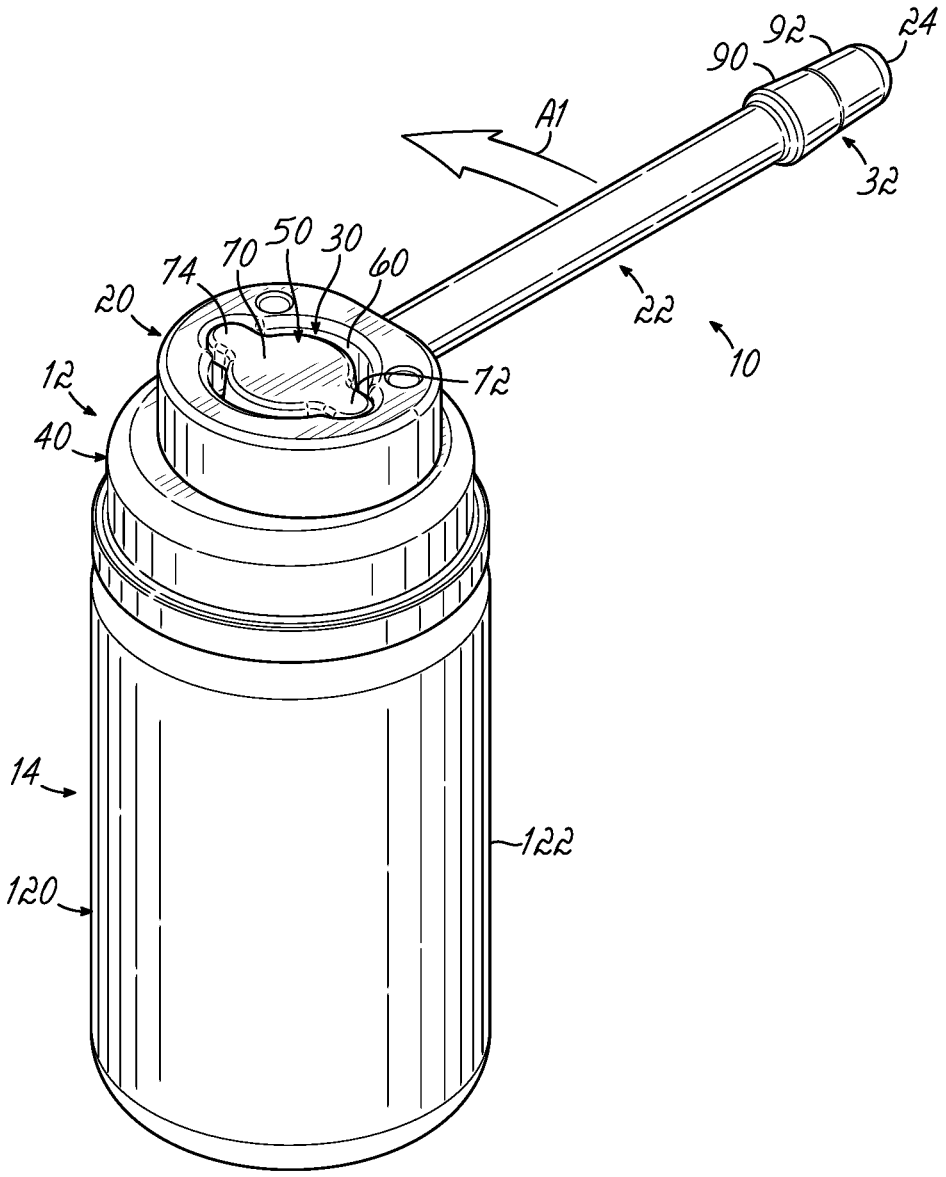
FIGS. 3A-3D are perspective views showing a series of steps for using the tool of FIG. 1 to remove a closure from a centrifuge bottle in accordance with another embodiment of the invention.

The aperture 30 of the tool head 20 is sized and shaped to receive a protruding portion of the lid 40, such as a handle 50 (FIG. 3A), for a rotating operation wherein the tool 10 is configured to be used as a wrench. In the embodiment shown, the aperture 30 includes a generally circular bore 60 with first and second oppositely disposed indentations 62, 64 extending therefrom such that the aperture 30 may interlock with the handle 50. In one embodiment, as shown in FIGS. 1 and 2, radially inwardly directed corners 65 are formed at the respective junctures of the first and second indentations 62, 64 with the generally circular bore 60. In this regard, the handle 50 may be similar to that described in Applicant's own co-pending application Ser. No. 14/936,196, to which the reader is referred. For example, the handle 50 may include a generally circular central portion 70 and first and second oppositely disposed finger grips 72, 74 extending therefrom (FIG. 3A).

The generally circular bore 60 of the aperture 30 may be sized to receive the generally circular central portion 70 of the handle 50 and the first and second indentations 62, 64 may be sized and shaped to receive the first and second finger grips 72, 74 of the handle 50, respectively, such that the aperture 30 may be capable of transferring torque to the handle 50 and thus the lid 40. More particularly, the surfaces of the generally circular bore 60 and the generally circular central portion 70 may be configured to be in contact or near-contact with each other, and the first and second indentations 62, 64 may be configured to engage with the surfaces of the first and second finger grips 72, 74, respectively, as the tool head 20 is rotated. To this end, the elongate shaft 22 is configured to be gripped by a user and receive a first force exerted by the user to generate a first torque at the tool head 20 that is transferred to the handle 50 via the aperture 30. Various other configurations of apertures may be used for various handle configurations. For example, an aperture may have four indentations for receiving a handle having four finger grips. Such an aperture may also be used to receive the illustrated handle 50.

Figure 3B:
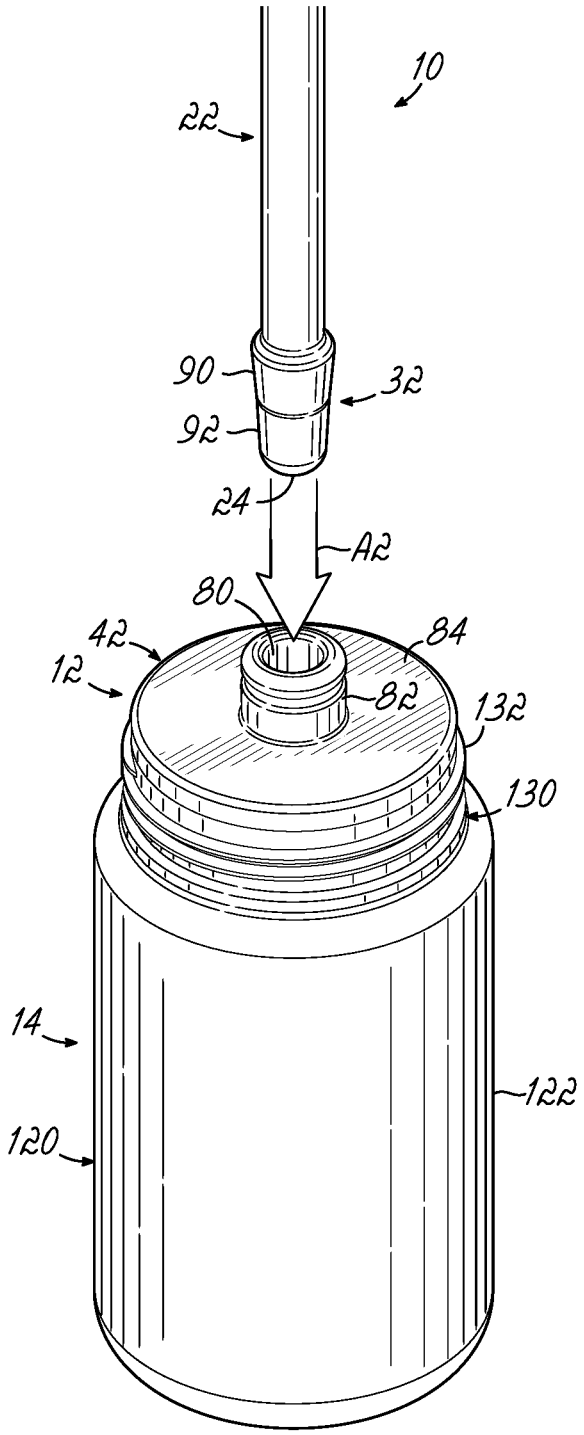

The tapered portion 32 of the elongate shaft 22 is sized and shaped to be inserted in a recessed portion of the sealing plug 42, such as a recess 80 (FIG. 3B), for a prying operation wherein the tool 10 is configured to be used as a lever or wedge. In the embodiment shown, the tapered portion 32 includes upper and lower tapered sections 90, 92 each tapering radially inwardly in a direction away from the tool head 20, such that the tapered portion 32 may be at least partially inserted and/or wedged in the recess 80 of the sealing plug 42. In one embodiment, the first and second tapered sections 90, 92 each have a generally frusto-conical profile, with the second tapered section 92 terminating in a rounded tip at the distal end 24. In any event, the recess 80 may be similar to that described in Applicant's own co-pending application Ser. No. 14/936,196. For example, the recess 80 may be a centrally located and generally circular recess provided in an upper boss 82 projecting from a central portion of an upper surface of a plug top wall 84, and may extend axially toward the plug top wall 84 (FIG. 3B).

When at least partially inserted in the recess, the tapered portion 32 may be capable of exerting a force on the recess 80, and thus the sealing plug 42, in a direction away from the centrifuge bottle 14. For example, the lower tapered section 92 of the tapered portion 32 may fit within the recess 80, and surfaces of the lower tapered section 92 may be configured to frictionally engage with surfaces of the recess 80 as the tool 10 is manipulated. To this end, the tool head 20 is configured to be gripped by a user and receive a second force exerted by the user to generate a second torque at the tapered portion 32 of the elongate shaft 22 that causes the tapered portion 32 to exert an output force on the recess 80 in a direction away from the centrifuge bottle 14. In one embodiment, the aperture 30 of the tool head 20 may be sized and/or shaped to receive at least a portion of the user's hand and thereby provide an ergonomic gripping point for the user during the prying operation. While upper and lower tapered sections 90, 92 are shown, a tapered portion may include any other number of tapered sections. For example, a tapered portion may include only a single tapered section.

In the embodiment shown, the tapered portion 32 is integrally formed with the elongate shaft 22 as a unitary piece, such that the tapered portion 32 and the elongate shaft 22 each terminate at the distal end 24 of the elongate shaft 22. However, it will be appreciated that other configurations may be utilized. For example, in an alternative embodiment a tapered portion may be a cap portion which is positioned over the distal end 24 of the elongate shaft 22. Such a tapered portion may be fixed to the distal end 24 via friction, adhesion, fastener(s), or any other suitable means.

As shown, the tool 10 includes first and second cavities, such as bores 100, 102, in the tool head 20 configured to retain corresponding first and second magnets 104, 106. The bores 100, 102 may comprise blind bores formed in the tool head 20 or, alternatively, bores which extend through the entire thickness of the tool head 20 as shown. The magnets 104, 106 may be configured to magnetically couple the tool 10 to a metallic surface (not shown), such as a surface of a centrifuge, workbench, or other object, in order to store the tool 10 in a convenient location when not in use. For example, the magnets 104, 106 may couple the tool 10 to a side surface of a centrifuge. While two bores 100, 102 for retaining two magnets 104, 106 are shown, it will be appreciated that any number of bores and/or magnets may be used without departing from the scope of the invention. In addition or alternatively, such bores may be provided elsewhere on the tool 10. For example, bores may be provided in the elongate shaft 22. Alternatively, the bores and/or magnets may be eliminated.

With reference to FIGS. 3A-3D, a method of removing the closure 12 from the centrifuge bottle 14 with the tool 10 is provided. As shown, the centrifuge bottle 14 includes a container body 120 having a body wall 122 defining an inner cavity 124, and a mouth 126 defining an opening 128 that communicates with the inner cavity 124. An upper end of the container body 120 includes a neck 130 having a first threaded portion 132 and terminating at the mouth 126. The inner cavity 124 is configured to hold a sample 140.

Initially, the centrifuge bottle 14 is in an upright position and the tool head 20 is fitted over the handle 50 of the lid 40 (FIG. 3A). As shown, this may involve positioning the tool 10 in a generally horizontally flat orientation. In any event, the aperture 30 of the tool head 20 and the handle 50 interlock with each other as described above. With the tool head 20 and the handle 50 interlocked, the user grips the elongate shaft 22 and applies a first force thereto to generate a first torque at the tool head 20, as indicated by the arrow A1, by rotating the tool 10. The aperture 30 of the tool head 20 transfers the first torque to the handle 50, and thus the lid 40, to loosen the coupling of the lid 40 to the centrifuge bottle 14. For example, the lid 40 may have a second threaded portion (not shown) engaged with the first threaded portion 132 of the centrifuge bottle 14, and the application of the first torque to the lid 40 may loosen the engagement of the second threaded portion with the first threaded portion 132.

In the embodiment shown, the first force is applied in a generally horizontal first plane, which is perpendicular to a longitudinal axis of the centrifuge bottle 14. However, the first force may be applied in any plane depending, for example, on the orientation of the centrifuge bottle 14. In any event, after the coupling of the lid 40 to the centrifuge bottle 14 has been loosened by the tool 10, the lid 40 may be completely removed from the centrifuge bottle 14.

Figure 3C:
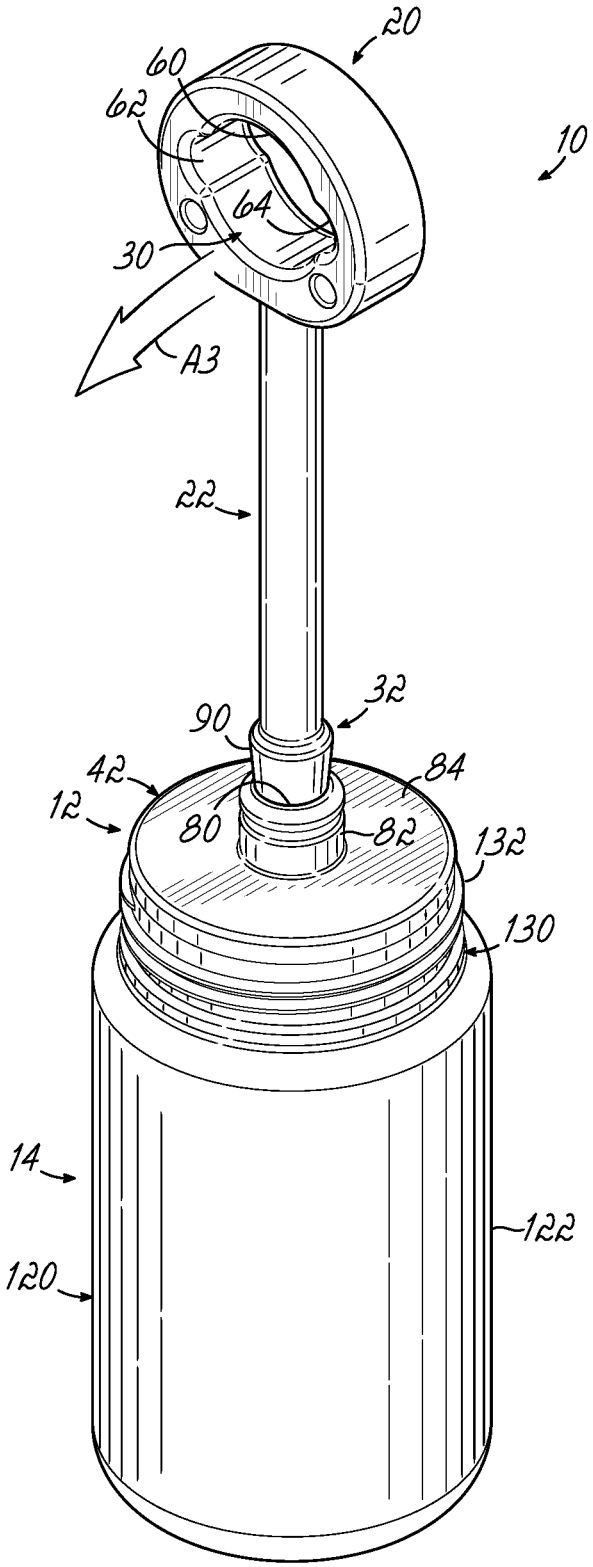

In some instances, after removing the lid 40 from the centrifuge bottle 14, the sealing plug 42 may remain coupled to the centrifuge bottle 14 (e.g., at the mouth 126) by a friction force and/or a suction force, and thus prevent the user from accessing the inner cavity 124 of the centrifuge bottle 14. In such cases, removing the lid 40 from the centrifuge bottle 14 may expose the recess 80 of the sealing plug 42. With the recess 80 exposed, the tapered portion 32 is at least partially inserted in the recess 80, as indicated by the arrow A2, by prying the tool 10 (FIG. 3B). For example, the lower tapered section 92 of the tapered portion 32 may be inserted in the recess 80. As shown, this may involve positioning the tool 10 in a generally vertical orientation. The user then applies a second force to the tool head 20 to generate a second torque at or near the tapered portion 32, as indicated by the arrow A3 (FIG. 3C). As a result, the tapered portion 32 engages the recess 80 and exerts an output force thereon in a direction away from the centrifuge bottle 14 to loosen the coupling of the sealing plug 42 to the centrifuge bottle 14. For example, the output force may be sufficient to overcome the friction force and/or suction force.

Figure 3D:
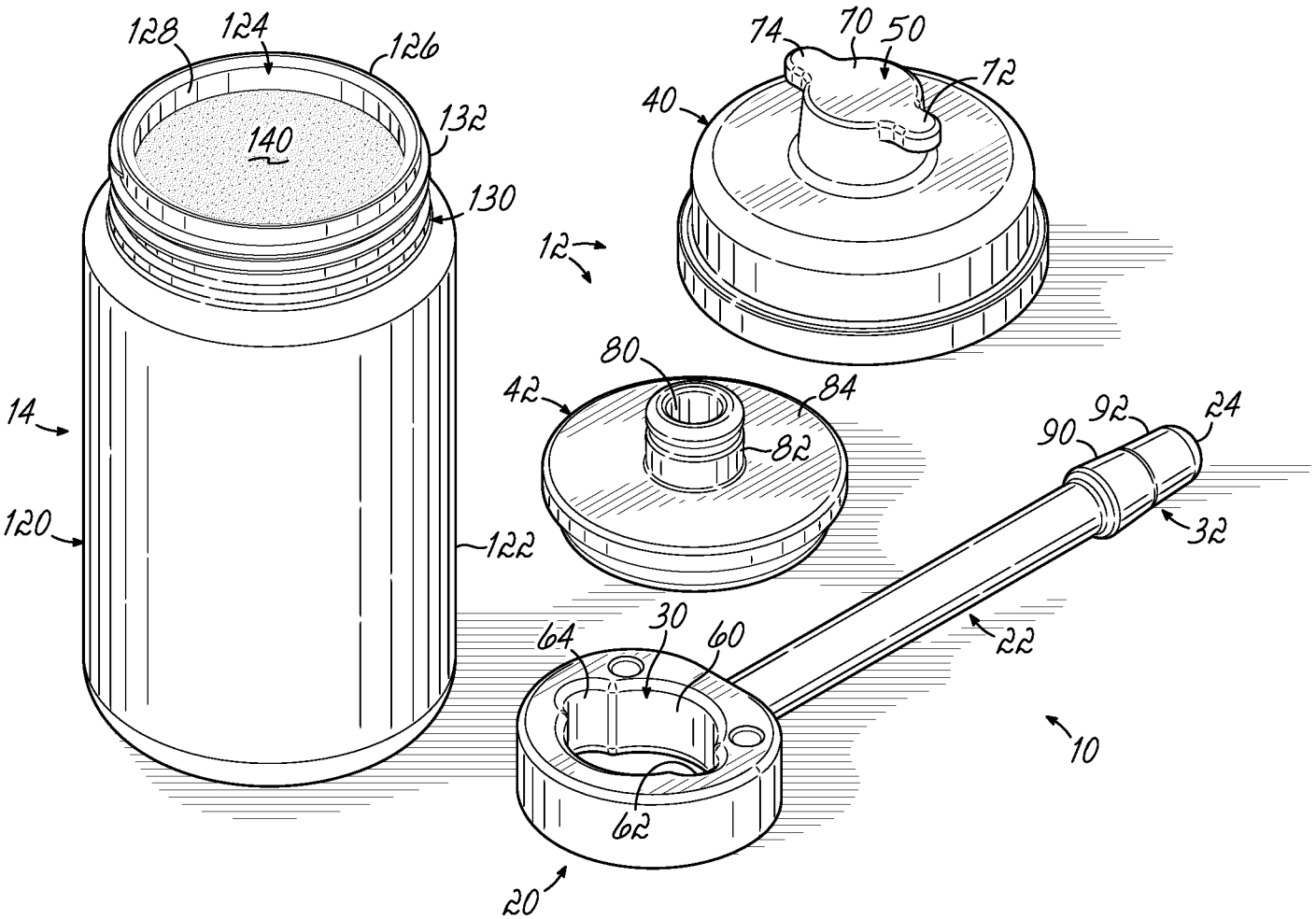

In the embodiment shown, the second force is applied in a generally vertical second plane, which is parallel to the axis of the centrifuge bottle 14 and transverse (e.g., perpendicular) to the first plane. However, the second force may be applied in any plane depending, for example, on the orientation of the centrifuge bottle 14. In any event, after the coupling of the sealing plug 42 to the centrifuge bottle 14 has been loosened, the sealing plug 42 may be completely removed from the centrifuge bottle 14 and the sample 140 within the inner cavity 124 of the centrifuge bottle 14 may be accessed (FIG. 3D).

It will be appreciated that during the rotating operation, the tool 10 provides a greater moment arm than a user may achieve by manually gripping the lid 40. The interlocking of the aperture 30 with the handle 50 also relieves the user of the need to manually grip the handle 50 with sufficient strength to rotate the handle 50, which may be a difficult task particularly if the user has small hands. Thus, the tool 10 improves the user's ability to successfully remove the lid 40 from the centrifuge bottle 14. It will also be appreciated that during the prying operation the tool 10 provides an ergonomic gripping point as well as a relatively large moment arm to improve the user's ability to successfully remove the sealing plug 42 from the centrifuge bottle 14 in the event that the sealing plug 42 separates from the lid 40 and remains coupled to the centrifuge bottle 14 after removal of the lid 40. In this manner, the tool 10 may improve a user's ability to fully remove the closure 12 from the centrifuge bottle 14.

Although the rotating operation has been described in the context of removing the lid 40 from the centrifuge bottle 14, it will be appreciated that a similar operation may be performed to tighten the lid 40 to the centrifuge bottle 14, such as by applying a third force to the elongate shaft 22 in a direction opposite the aforementioned first force.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A tool for removing first and second centrifuge bottle closure members from a centrifuge bottle, comprising:

a tool head including an aperture extending entirely through the tool head and being sized and shaped to receive and entirely encircle a protruding portion of the first centrifuge bottle closure member, the aperture including a generally circular bore and first and second arcuate indentations extending radially outwardly from the generally circular bore so as to form radially inwardly directed corners at respective junctures of the first and second indentations with the generally circular bore; and an elongate shaft extending from the tool head to a distal end and including a tapered portion adjacent the distal end, wherein the tapered portion is sized and shaped to be at least partially inserted in a recessed portion of the second centrifuge bottle closure member;

wherein the aperture is configured to transfer torque to the first centrifuge bottle closure member during a rotating operation of the tool;

wherein the tapered portion is configured to exert an output force on the second centrifuge bottle closure member during a prying operation of the tool; and wherein a spacing between a respective pair of adjacent corners of the radially inwardly directed corners in a cross-width direction of the tool is greater than a spacing between a respective pair of opposing corners of the radially inwardly directed corners in a longitudinal direction of the tool.

2. The tool of claim 1, further comprising at least one cavity in at least one of the tool head or the elongate shaft and configured to retain at least one magnet.

3. The tool of claim 2, further comprising the at least one magnet retained in the at least one cavity and configured to magnetically couple the tool to a surface of a centrifuge.

4. The tool of claim 1, wherein the elongate shaft is configured to be gripped by a user during the rotating operation of the tool.

5. The tool of claim 4, wherein the tool head is configured to be gripped by the user during the prying operation of the tool.

6. The tool of claim 5, wherein the aperture is sized to receive at least a portion of the user's hand during the prying operation of the tool.

7. The tool of claim 1, wherein the first and second indentations are oppositely disposed.

8. A method of removing first and second centrifuge bottle closure members coupled to a centrifuge bottle, the first centrifuge bottle closure member including a protruding portion and the second centrifuge bottle closure member including a recessed portion, the method comprising:

fitting a tool head of a tool over the protruding portion of the first centrifuge bottle closure member;

applying a first force to an elongate shaft of the tool;

generating a first torque at the tool head from the first force;

transferring the first torque to the protruding portion to loosen the coupling of the first centrifuge bottle closure member to the centrifuge bottle;

removing the first centrifuge bottle closure member from the centrifuge bottle;

at least partially inserting a tapered portion of the elongate shaft in the recessed portion;

applying a second force to the tool head;

generating a second torque at the tapered portion from the second force;

generating an output force from the second torque, the output force being exerted by the tapered portion on the recessed portion to loosen the coupling of the second centrifuge bottle closure member to the centrifuge bottle; and removing the second centrifuge bottle closure member from the centrifuge bottle.

9. The method of claim 8, wherein the centrifuge bottle includes a first threaded portion and wherein the first centrifuge bottle closure member comprises a lid having a second threaded portion engaged with the first threaded portion, and wherein the step of transferring the first torque includes loosening the engagement of the first and second threaded portions.

10. The method of claim 9, wherein the protruding portion comprises a handle protruding from the lid.

11. The method of claim 8, wherein the second centrifuge bottle closure member comprises a sealing plug that is coupled to the centrifuge bottle by at least one of a suction force or a friction force, and wherein the step of generating an output force includes generating an output force sufficient to overcome the at least one of a suction force or a friction force to loosen the sealing plug from the centrifuge bottle.

12. The method of claim 8, wherein the recessed portion is covered by the first centrifuge bottle closure member when the first centrifuge bottle closure member is coupled to the centrifuge bottle, and wherein the removing the first centrifuge bottle closure member from the centrifuge bottle includes exposing the recessed portion.

* * * * *